US008656651B1

(12) United States Patent
Scarano, Jr. et al.

(10) Patent No.: US 8,656,651 B1
(45) Date of Patent: Feb. 25, 2014

(54) ANCHORING SYSTEM

(76) Inventors: Michael Scarano, Jr., Bernardsville, NJ (US); Giani Bin, Bernardsville, NJ (US)

( * ) Notice: Subject to any disclaimer, the term of this patent is extended or adjusted under 35 U.S.C. 154(b) by 0 days.

(21) Appl. No.: 13/558,715

(22) Filed: Jul. 26, 2012

(51) Int. Cl.
*E04B 1/98* (2006.01)

(52) U.S. Cl.
USPC ..... 52/157; 52/161

(58) Field of Classification Search
USPC ..... 52/157, 161, 165, 155, 156; 248/156
See application file for complete search history.

(56) References Cited

U.S. PATENT DOCUMENTS 1,883,477 A 10/1932 Bash
4,832,304 A 5/1989 Morgulis
4,910,902 A * 3/1990 Anderson ..... 40/607.06
5,046,699 A * 9/1991 Perreault et al. ..... 248/533
5,564,232 A * 10/1996 Callaway ..... 5/4
5,881,978 A * 3/1999 Rust ..... 248/156
5,921,035 A * 7/1999 Kempf ..... 52/157
6,095,081 A * 8/2000 Gochenour ..... 116/209
6,629,389 B1 * 10/2003 Rust ..... 52/157
2009/0277368 A1 11/2009 Bolloch

* cited by examiner

*Primary Examiner* — Basil Katcheves
(74) *Attorney, Agent, or Firm* — Emery L. Tracy; Ruth Eure

(57) ABSTRACT

An anchoring system for anchoring an item to the ground is provided. The anchoring system comprises an elongated main shaft having a first end and a second end. At least one bracket is mounted to the main shaft approximately halfway between the first end and the second end of the main shaft. A securing mechanism is associated with the at least one bracket for releasably securing the item to the at least one bracket. An elliptical, angled auger is mounted at the second end of the main shaft. Upon securing the item to the at least one bracket and securing the second end of the main shaft into the ground, the item is securely positioned into a desired position.

20 Claims, 6 Drawing Sheets

ANCHORING SYSTEM

BACKGROUND OF THE INVENTION

1. Field of the Invention

This invention relates generally to an anchoring system and, more particularly, the invention relates to an anchoring system providing a durable, user-friendly means of anchoring virtually any item.

2. Description of the Prior Art

Many times, it is desirable to anchor items to the ground to prevent the items from inadvertently shifting or moving. Throughout history earth auger anchors have been used to anchor and support many objects, including tents, umbrellas, poles and so forth. These augers usually have several common physical characteristics, including a central solid or hollow shaft which mounts a helical flight on one end that functions to auger into the earth when the shaft is rotated. The other end of the shaft can be mounted to a handle or lever from which one can attach a rope or cable. With these kinds of augers it is very easy to pull them out of soft sand because the pull strength is only applied to the top section of the auger. These kinds of auger shafts bend easily. Therefore, it would be desirable to have an anchoring system that is securely held to the ground while also being able to support items in a desired position.

SUMMARY

The present invention is an anchoring system for anchoring an item to the ground. The anchoring system comprises an elongated main shaft having a first end and a second end. At least one bracket is mounted to the main shaft approximately halfway between the first end and the second end of the main shaft. A securing mechanism is associated with the at least one bracket for releasably securing the item to the at least one bracket. An elliptical, angled auger is mounted at the second end of the main shaft. Upon securing the item to the at least one bracket and securing the second end of the main shaft into the ground, the item is securely positioned into a desired position.

In addition, the present invention is a method for anchoring an item to the ground. The method comprises providing an elongated main shaft having a first end and a second end, mounting at least one bracket to the main shaft approximately halfway between the first end and the second end of the main shaft, releasably securing the item to the at least one bracket, mounting an elliptical, angled auger mounted at the second end of the main shaft, and the item being securely positioned into a desired position.

The present invention further includes an anchoring system for anchoring an item to the ground. The anchoring system comprises an elongated main shaft having a first end and a second end. A vertical circular bracket is mounted to the main shaft approximately halfway between the first end and the second end of the main shaft. Aligned apertures are formed in the approximate center of the vertical circular bracket. A pin is insertable into the aligned aperture and through a corresponding aperture formed in the item. An additional aperture is formed in the vertical circular bracket with a nut welded over the aperture. A set screw is threadably insertable into the additional aperture and against the item. An elliptical, angled auger is mounted at the second end of the main shaft. Upon securing the item to the at least one bracket and securing the second end of the main shaft into the ground, the item being securely positioned into a desired position.

DETAILED DESCRIPTION OF THE PREFERRED EMBODIMENTS

Figure 3:
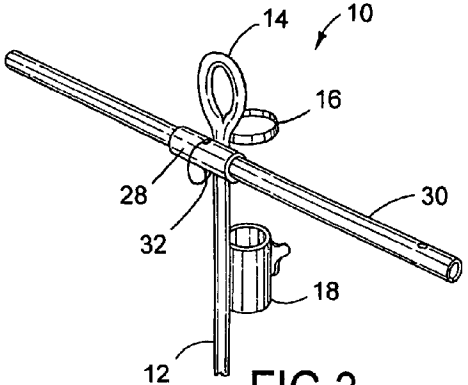
FIG. 3 is a rear perspective view illustrating the anchoring system, constructed in accordance with the present invention, with a post horizontally mounted within the anchoring system.
Figure 4:
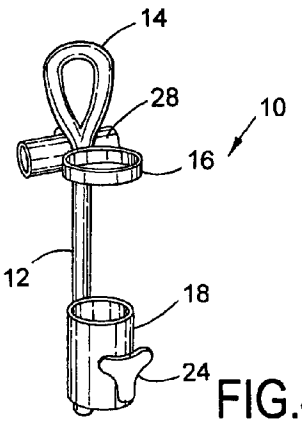
FIG. 4 is a front perspective view illustrating the anchoring system, constructed in accordance with the present invention, with the anchoring system anchored into the ground.
Figure 2:
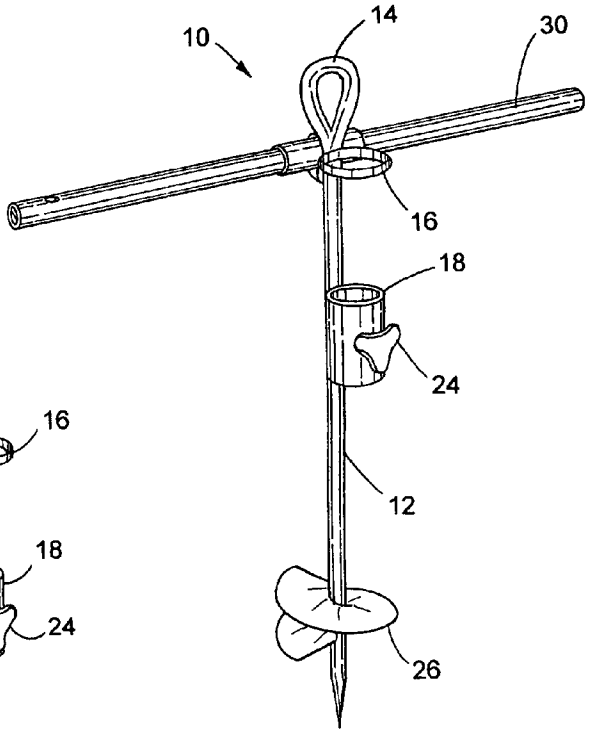
FIG. 2 is a front perspective view illustrating the anchoring system, constructed in accordance with the present invention, with a post horizontally mounted within the anchoring system.
Figure 1:
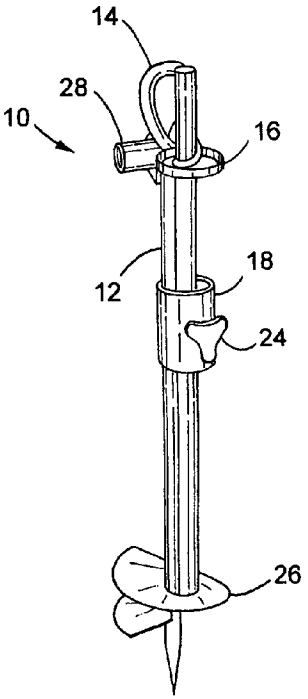
FIG. 1 is a front perspective view illustrating an anchoring system, constructed in accordance with the present invention, with a post vertically mounted within the anchoring system.
Figure 5:
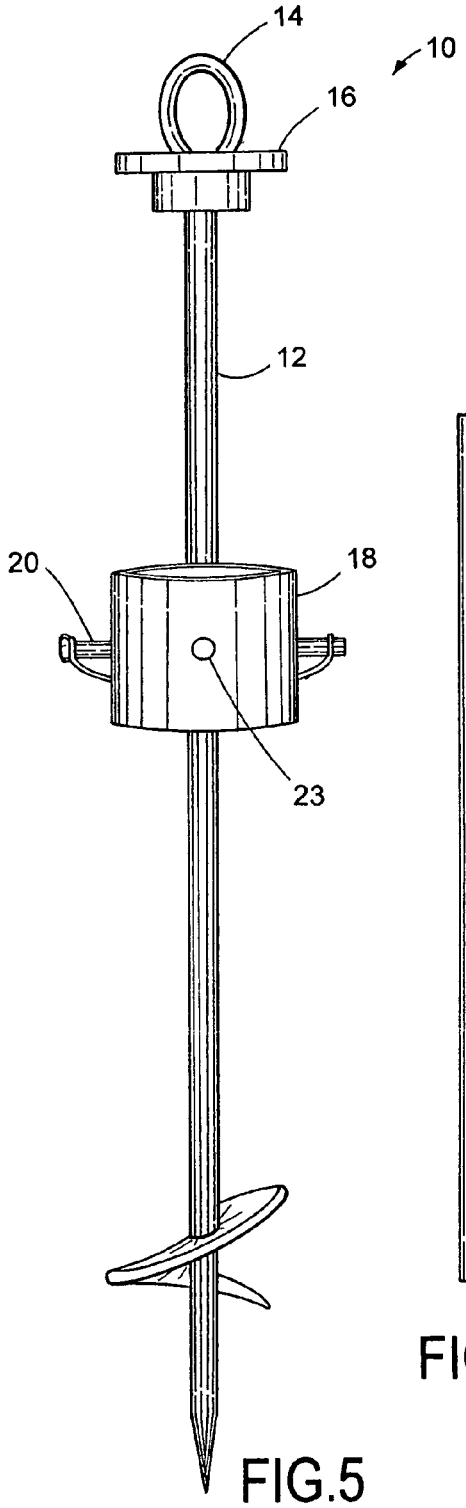
FIG. 5 is an elevational front view illustrating the anchoring system, constructed in accordance with the present invention.
Figure 6:
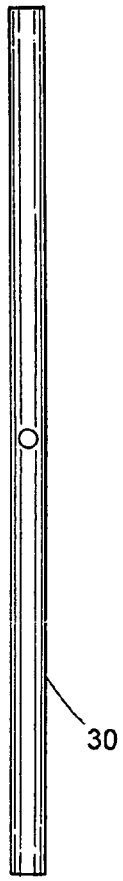
FIG. 6 is an elevational front view illustrating a post usable with the anchoring system, constructed in accordance with the present invention.
Figure 7:
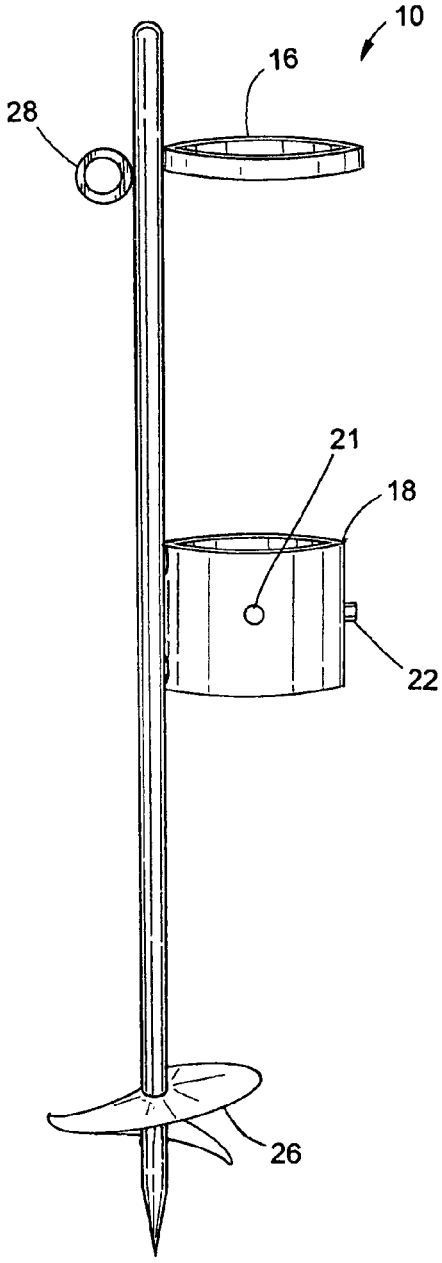
FIG. 7 is an elevational side view illustrating the anchoring system, constructed in accordance with the present invention.
Figure 8:
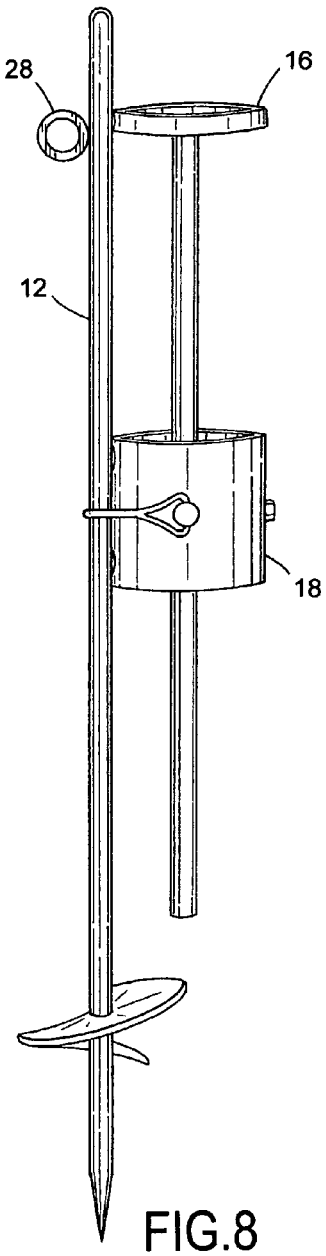
FIG. 8 is an elevational side view illustrating the anchoring system, constructed in accordance with the present invention, with a post vertically mounted within the anchoring system.
Figure 10:
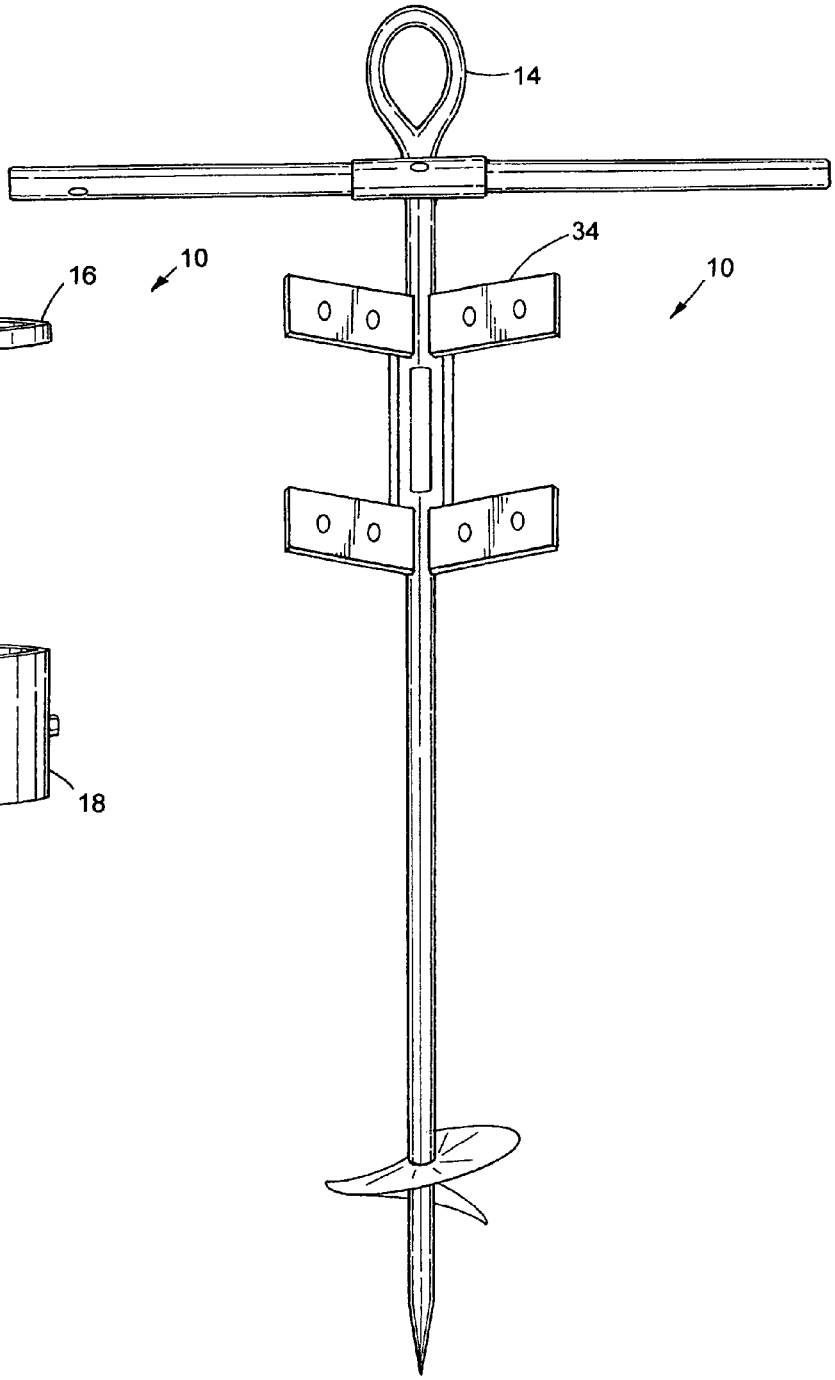
FIG. 10 is an elevational rear view illustrating the anchoring system of FIG. 9, constructed in accordance with the present invention.
Figure 11:
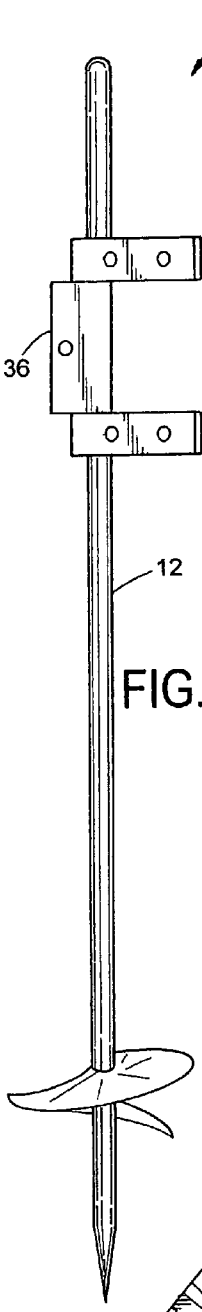
FIG. 11 is an elevational side view illustrating the anchoring system of FIG. 9, constructed in accordance with the present invention.
Figure 9:
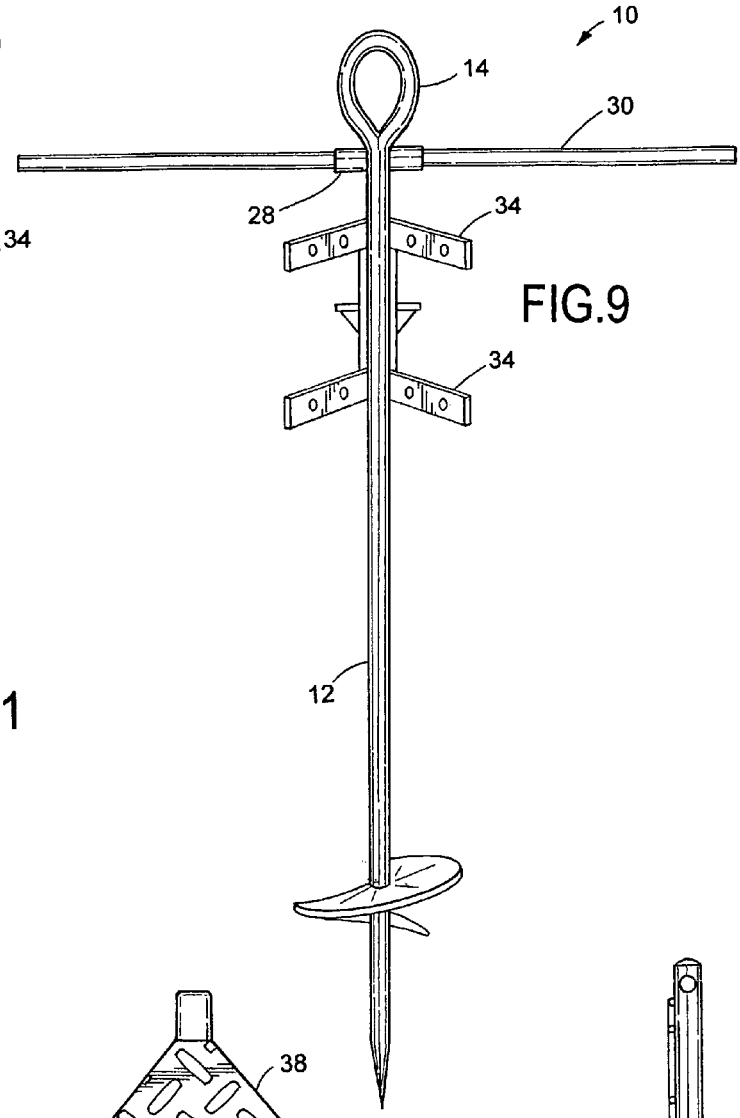
FIG. 9 is an elevational front view illustrating another embodiment of the anchoring system, constructed in accordance with the present invention.
Figure 12:
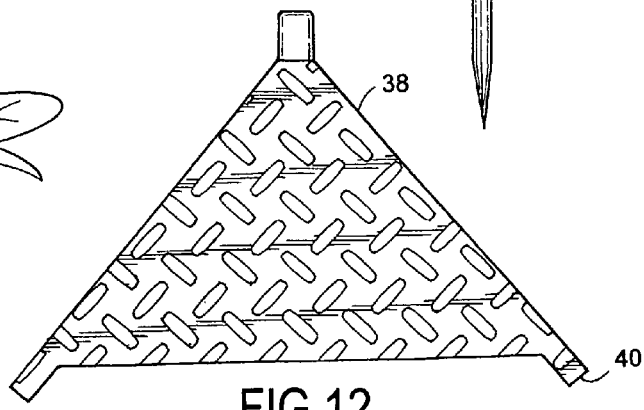
FIG. 12 is an elevational front view illustrating an anchoring piece for the anchoring system of FIG. 9, constructed in accordance with the present invention.
Figure 13:
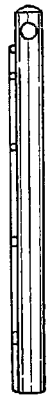
FIG. 13 is an elevational side view illustrating the anchoring piece of the anchoring system of FIG. 9, constructed in accordance with the present invention.
Figure 14:
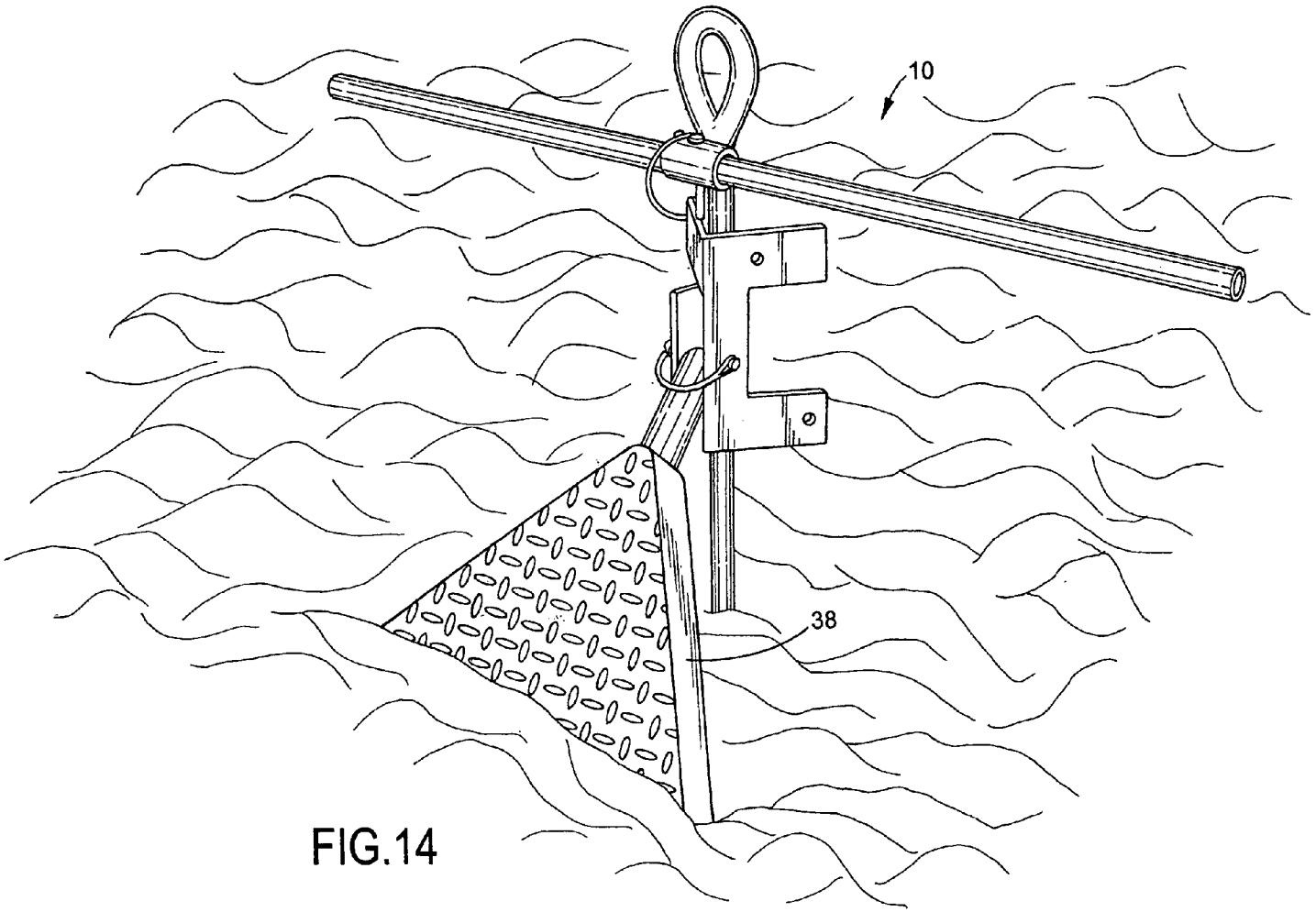
FIG. 14 is a perspective view illustrating the anchoring piece of the anchoring system of FIG. 9, constructed in accordance with the present invention.
Figure 15:
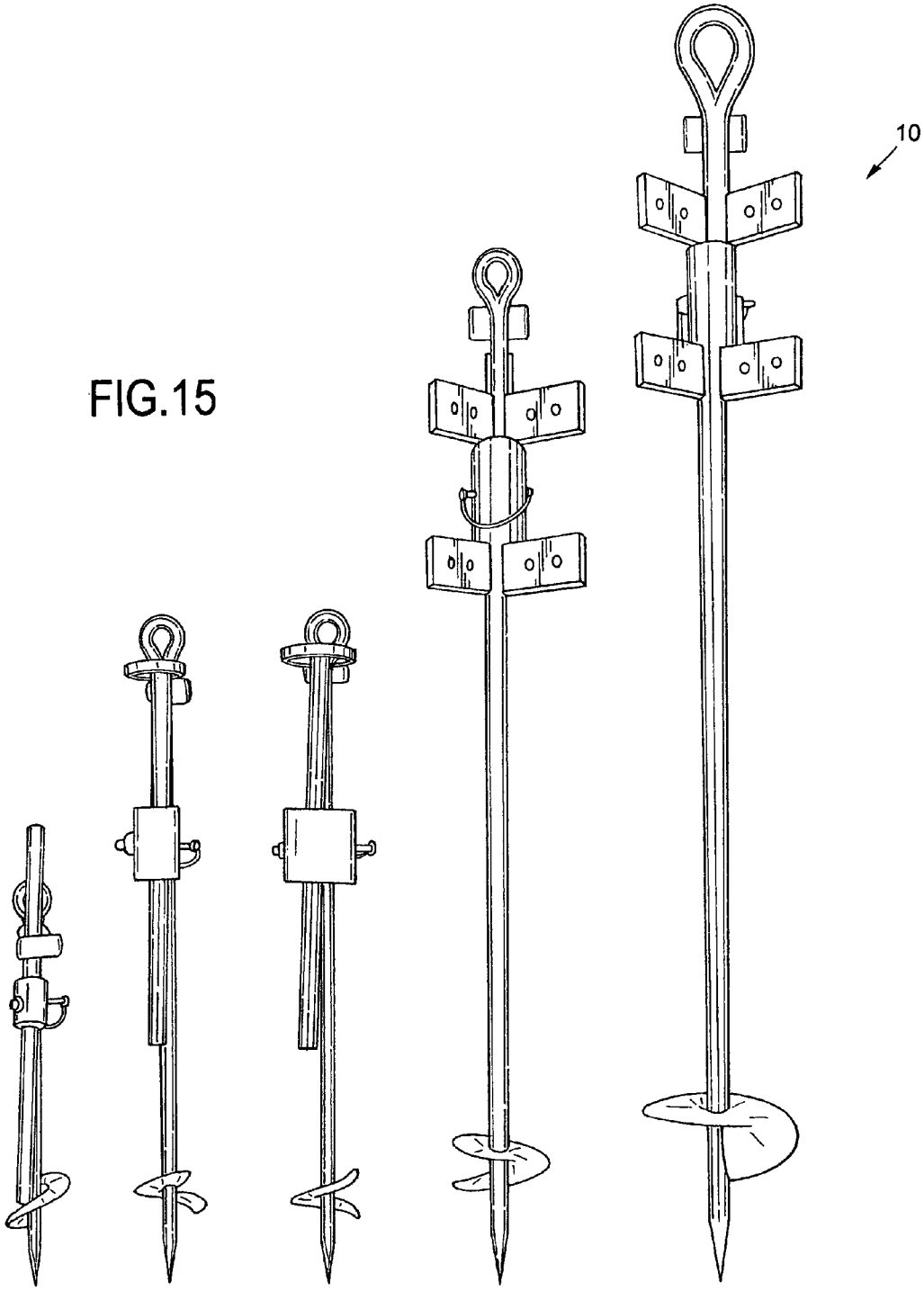
FIG. 15 are perspective views illustrating various embodiments and sizes of the anchoring system, constructed in accordance with the present invention.

As illustrated in FIGS. 1-15, the present invention is an anchoring system, indicated generally at 10, providing a durable, user-friendly means of anchoring virtually any item in a desired position. The anchoring system 10 of the present invention is preferably constructed from a combination of steel, aluminum, and plastic materials although constructing the anchoring system from other materials is within the scope of the present invention.

In an embodiment of the anchoring system 10 of the present invention, the anchoring system 10 includes an elongated main shaft 12 having a first end and a second end. The first end of the main shaft 12 has a substantially oval-shaped handle 14 extending vertically from the first end of the main shaft 12. Located on a front side of the main shaft 12 of the anchoring system 10 of the present invention is a substantially circular guide 16 aligned with a larger, vertical circular bracket 18 approximately centrally located on the main shaft of the anchoring system 10. The circular guide 16 and the vertical circular bracket 18 work in tandem and serves as handy security for an independent item (such as a flag pole or similar) when inserted through the circular guide 16 and the vertical circular bracket 18. The vertical circular bracket 18 has aligned apertures 21 formed in the approximate center of a top and a bottom of the vertical circular bracket 18 allowing insertion of a pin 20 or the like through a corresponding aperture in the item. Also, an additional aperture 23 can be formed in the vertical circular bracket 18 with a nut 22 welded over the aperture 23 for threadably receiving a set screw 24 or the like. The pin 20 and set screw 24 can be releasably secured through and against, the item, respectively, thereby inhibiting the item from moving within or becoming dislodged from the vertical circular bracket 18.

The anchoring system 10 of the present invention culminates in an elliptical, angled auger 26 at the second end of the main shaft 12 and positioned above the sharp, tapered second end of the main shaft 12. The auger 26 facilitates quick, easy, and secure insertion of the anchoring system 10 into the ground.

Directly below the handle 14, on a rear side of the main shaft 12 of the anchoring system 10 of the present invention, a horizontally positioned, open horizontal circular bracket 28 is mounted to the first end of the main shaft 12 for holding a torque bar 30 in a substantially horizontal position. Aligned apertures formed in the approximate center of a top and a bottom of the horizontal circular bracket 28 allows insertion of a pin 32 or the like through a corresponding aperture in the torque bar 30. The pin 32 can be releasably secured thereby inhibiting the torque bar 30 from moving within or becoming dislodged from the horizontal circular bracket 28. The torque bar 30 provides torque for insertion and removal of the anchoring system 10 into and from the ground while also serving as an additional surface upon which to tie off ropes and cords, if needed.

In another embodiment, as best illustrated in FIGS. 9-14, the anchoring system 10 of the present invention has a pair of spaced brackets 34 extending from the main shaft 12. Each of the brackets 34 has a series of apertures for receiving pins for securing the item thereto. A U-shaped bracket 36 is secured to the main shaft 12 behind the spaced brackets 34. The U-shaped bracket 36 has an aperture for pivotally securing a substantially triangular anchoring piece 38 that works to further stabilize the anchoring system 10. Preferably, the anchoring piece 38 has extensions 40 extending from the end of the anchoring piece 38 to further "dig" into the ground and stabilize the anchoring system 10.

Relatively simple in design yet extremely effective in application, use of the anchoring system 10 of the present invention is very easy and straight forward. First, the anchoring system 10 is positioned in a vertical manner, with the sharpened end pressed against the ground. Next, the torque bar is inserted into the horizontal circular bracket and releasably secured therein via the handy locking pin. A user then pushes down on the anchoring system 10 using the torque bar threading the anchoring system 10 in a clockwise manner until the main shaft augers to the desired depth. This process can be repeated for as many anchoring systems 10 as required for the task at hand.

The universality of the anchoring system 10 of the present invention affords many significant benefits and advantages. Foremost, this self-contained anchoring system 10 provides a durable, user-friendly means of anchoring virtually any item. In this manner, multiple anchoring systems 10 can be employed for any job, taking up very little space before use. With its simple design, an anchoring system 10 can be erected and ready for any application in a mere matter of seconds. Perhaps the most significant advantage of the anchoring system 10 is its versatility. Easily adaptable to a virtually endless array of uses, the anchoring system 10 proves ideal for both work and recreation needs. For example, farmers can easily employ the anchoring system 10 to hold down tarps or to anchor fencing center posts. Beach-goers will certainly appreciate how the anchoring system 10 quickly secures items such as umbrellas and volleyball nets, with very little effort on the part of the user. Campers will delight in the simplicity and durability of the anchoring system 10, as it handily facilitates the perfectly anchored tent. Homeowners planning outdoor festivities such as cookouts or cocktail parties will be able to instantly construct awnings and anchor attractive runways of tiki torches. Tailgaters at sporting events are able to employ the anchoring system to better guard against the heat of the sun or a sudden rainstorm. Fishermen, hunters, boaters, military personnel, and landscapers are just a few of the other groups who will greatly benefit from a product such as the anchoring system 10. The anchoring system 10 of the present invention readily enhances any job or activity that requires an anchoring system. With its unique, compactable design, the anchoring system 10 proves an invaluable addition to any tool shed or utility closet.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. An anchoring system for anchoring an item to the ground, the anchoring system comprising:

an elongated main shaft having a first end and a second end;

at least one bracket mounted to the main shaft approximately halfway between the first end and the second end of the main shaft, the at least one bracket being a vertical circular bracket;

securing means associated with the at least one bracket for releasably securing the item to the at least one bracket, the securing means including an aperture formed in the vertical circular bracket with a nut welded over the aperture for threadably receiving a set screw; and an elliptical, angled auger mounted at the second end of the main shaft;

wherein upon securing the item to the at least one bracket and securing the second end of the main shaft into the ground, the item being securely positioned into a desired position.

2. The anchoring system of claim 1 and further comprising:

a substantially oval-shaped handle extending vertically from the first end of the main shaft.

3. The anchoring system of claim 2 and further comprising:

a substantially circular guide mounted to the main shaft adjacent the first end of the main shaft, the circular guide aligned with the vertical circular bracket for receiving the item.

4. The anchoring system of claim 1 wherein the securing means includes aligned apertures formed in the approximate center of the vertical circular bracket and a pin insertable into the aligned aperture and through a corresponding aperture formed in the item.

5. The anchoring system of the claim 1 wherein the auger is positioned above a sharp, tapered second end of the main shaft.

6. The anchoring system of claim 1 and further comprising:

a horizontally positioned, open horizontal circular bracket mounted to the first end of the main shaft.

7. The anchoring system of claim 6 and further comprising:

a torque bar receivable within the horizontal circular bracket in a substantially horizontal position.

8. The anchoring system of claim 7 and further comprising:

aligned apertures formed in an approximate center of a top and a bottom of the horizontal circular bracket allowing insertion of a pin through a corresponding aperture in the torque bar.

9. The anchoring system of claim 1 wherein the at least one bracket is a pair of spaced brackets extending from the main shaft, each of the brackets has a series of apertures for receiving pins for securing the item thereto.

10. The anchoring system of claim 9 and further comprised:

a U-shaped bracket secured to the main shaft behind the spaced brackets, the U-shaped bracket having an aperture for pivotally securing a substantially triangular anchoring piece.

11. The anchoring system of claim 10 and further comprising:

extensions extending from the end of the anchoring piece.

12. An anchoring system for anchoring an item to the ground, the anchoring system comprising:

an elongated main shaft having a first end and a second end;

a vertical circular bracket mounted to the main shaft approximately halfway between the first end and the second end of the main shaft;

aligned apertures formed in the approximate center of the vertical circular bracket;

a pin insertable into the aligned aperture and through a corresponding aperture formed in the item;

an additional aperture formed in the vertical circular bracket with a nut welded over the aperture;

a set screw threadably insertable into the additional aperture and against the item; and an elliptical, angled auger mounted at the second end of the main shaft;

wherein upon securing the item to the at least one bracket and securing the second end of the main shaft into the ground, the item being securely positioned into a desired position.

13. The anchoring system of claim 12 and further comprising:

a substantially oval-shaped handle extending vertically from the first end of the main shaft.

14. The anchoring system of claim 12 and further comprising:

a substantially circular guide mounted to the main shaft adjacent the first end of the main shaft, the circular guide aligned with the vertical circular bracket for receiving the item.

15. The anchoring system of claim 14 and further comprising:

a horizontally positioned, open horizontal circular bracket mounted to the first end of the main shaft.

16. The anchoring system of claim 15 and further comprising:

a torque bar receivable within the horizontal circular bracket in a substantially horizontal position.

17. The anchoring system of claim 16 and further comprising:

aligned apertures formed in an approximate center of a top and a bottom of the horizontal circular bracket allowing insertion of a pin through a corresponding aperture in the torque bar.

18. An anchoring system for anchoring an item to the ground, the anchoring system comprising:

an elongated main shaft having a first end and a second end;

at least one bracket mounted to the main shaft approximately halfway between the first end and the second end of the main shaft;

securing means associated with the at least one bracket for releasably securing the item to the at least one bracket;

an elliptical, angled auger mounted at the second end of the main shaft;

a horizontally positioned, open horizontal circular bracket mounted to the first end of the main shaft;

a torque bar receivable within the horizontal circular bracket in a substantially horizontal position; and aligned apertures formed in an approximate center of a top and a bottom of the horizontal circular bracket allowing insertion of a pin through a corresponding aperture in the torque bar;

wherein upon securing the item to the at least one bracket and securing the second end of the main shaft into the ground, the item being securely positioned into a desired position.

19. The anchoring system of claim 18 wherein the at least one bracket is a vertical circular bracket.

20. The anchoring system of claim 19 wherein the securing means includes an aperture formed in the vertical circular bracket with a nut welded over the aperture for threadably receiving a set screw.

* * * * *